US005127237A

United States Patent [19]

Sendo et al.

[11] Patent Number: 5,127,237

[45] Date of Patent: Jul. 7, 1992

[54] EXPANSION VALVE

[75] Inventors: Isao Sendo; Tokumi Tsuquwa, both of Tokyo, Japan

[73] Assignees: TGK Co. Ltd., Tokyo, Japan; Deutsche Controls GmbH, Munich, Fed. Rep. of Germany

[21] Appl. No.: 620,655

[22] Filed: Dec. 3, 1990

[30] Foreign Application Priority Data

Jan. 26, 1990 [JP] Japan ..... 2-6350[U]

[51] Int. Cl.[5] ..... F25B 41/04

[52] U.S. Cl. ..... 62/225; 236/92 B

[58] Field of Search ..... 62/225; 236/92 B

[56] References Cited

U.S. PATENT DOCUMENTS

| | | | |
|---|---|---|---|
| Re. 23,706 | 9/1953 | Lange | 62/225 |
| 3,855,836 | 12/1974 | Takahashi et al. | 62/225 X |
| 4,819,443 | 4/1989 | Watanabe et al. | 62/225 |
| 4,979,372 | 12/1990 | Tanaka | 62/225 |

*Primary Examiner*—William E. Tapolcai
*Attorney, Agent, or Firm*—Nilles & Nilles

[57] ABSTRACT

An expansion valve (10) for controlling the flow rate of refrigerant supplied to an evaporator (1) of a refrigerating system comprises a temperature-sensing chamber (30) entirely provided within the housing (11) of said expansion valve in a low pressure passage (12) thereof. Said passage (13) is connected to the outlet of said evaporator (1) and the inlet of a compressor (2), for converting a temperature change into a pressure change in order to actuate a valve mechanism (20) in response to a rise and lowering in pressure of said temperature-sensing chamber to open and close a passage (13) for adiabatic expansion of the refrigerant. Said temperature-sensing chamber (30) contains a sealed gas charge and an adsorbent material (35) for adsorbing and releasing said gaseous medium in accordance with temperature changes sensed.

21 Claims, 2 Drawing Sheets

EXPANSION VALVE

BACKGROUND OF THE INVENTION

1. Field of the Invention

The present invention relates to an expansion valve which is provided in a refrigerating system to sense the temperature of the refrigerant delivered from an evaporator to a compressor and automatically control the flow rate of the refrigerant entering the evaporator.

2. Description of the Related Art

An expansion valve of the type described above is generally provided with a low-pressure passage having one end thereof connected to the outlet of an evaporator and the other end thereof connected to the inlet of a compressor to pass low-temperature and low-pressure refrigerant and another passage having one end thereof connected to the outlet of a reservoir accommodating high-pressure liquid refrigerant and the other end thereof connected to the inlet of the evaporator to adiabatically expand high-temperature and high-pressure refrigerant. In addition, the expansion valve is provided with a temperature-sensing chamber which senses the temperature of the refrigerant in the low-pressure passage and changes in pressure in response to a change in the refrigerant temperature to control the degree of opening of a valve provided in the passage for adiabatic expansion by the operation of the temperature-sensing chamber, thereby controlling the flow rate of the refrigerant supplied to the evaporator.

The above-described conventional expansion valve suffers, however, from the following problems. Since the temperature-sensing chamber is provided on the outer surface of the expansion valve unit, the chamber is affected by the ambient temperature, so that the flow rate control of the refrigerant is not always accurately effected and the response of the flow rate control to a change in the temperature of the low-pressure refrigerant is inferior.

In many cases, the temperature-sensing chamber is arranged such that a gas which is the same as the refrigerant circulated through the passage for adiabatic expansion and the low-pressure passage is sealed in the temperature-sensing chamber so that the chamber changes in pressure in response to a change in the pressure of the gas. In this case, the operating characteristics (temperature-pressure characteristics) of the temperature-sensing chamber are uniformly determined by the inherent vapor pressure characteristics of the sealed gas. For this reason, there have heretofore been cases where it is impossible to set temperature-pressure characteristics in conformity to each particular refrigerating system and hence impossible to effect optimal flow rate control of the refrigerant.

Since in the prior art the temperature-sensing chamber and the valve mechanism are individually assembled to the expansion valve unit from both sides thereof, it is not easy to assemble, disassemble and adjust the expansion valve and it is difficult to carry out maintenance. Therefore, when a trouble occurs, in many cases the whole expansion valve unit must be changed for a new one, which is considerably uneconomical.

SUMMARY OF THE INVENTION

A first object of the present invention is to provide an expansion valve designed so that the temperature-sensing chamber is capable of faithfully sensing the temperature of the refrigerant coming out of the evaporator and accurately effecting flow rate control without being affected by the ambient temperature.

A second object of the present invention is to provide an expansion valve designed so that the operating characteristics (temperature-pressure characteristics) of the temperature-sensing chamber can be set as desired so as to be most conformable to the refrigerating system concerned.

A third object of the present invention is to provide an expansion valve designed so that the temperature-sensing chamber and the valve mechanism can be readily assembled to and removed from the expansion valve unit.

Other objects and advantages of the present invention will become apparent from the following detailed description of an illustrated embodiment of the invention.

According to the present invention, there is provided an expansion valve for controlling the flow rate of refrigerant supplied to an evaporator of a refrigerating system comprising: a low-pressure passage having one end thereof connected to the outlet of the evaporator and the other end thereof connected to the inlet of a compressor to pass low-temperature and low-pressure refrigerant; a passage having one end thereof connected to the outlet of a reservoir accommodating high-pressure liquid refrigerant and the other end thereof connected to the inlet of the evaporator to adiabatically expand high-temperature and high-pressure refrigerant; a temperature-sensing chamber provided inside the low-pressure passage, in which are sealed a gas for converting a temperature change into a pressure change and an adsorbent for adsorbing and releasing the gas in accordance with a temperature change so that the chamber changes in pressure in response to a change in the temperature of the refrigerant in the low-pressure passage; and a valve mechanism driven in response to a rise and lowering in pressure of the temperature-sensing chamber to open and close the passage for adiabatic expansion. The adsorbent material in the chamber adsorbs gas molecules at relatively low temperatures and releases said molecules at relatively high temperatures. The adsorbing performance of the adsorbent material substantially differs from one type of gaseous medium to another. By relying on that fact, and, e.g., by selecting the volumetric ratio between the adsorbent material and the gas charge and/or by selecting the pressure and/or the type and particle size of the adsorbent material, a pressure/temperature-characteristics of the chamber can be achieved, which optimally is adapted to the operating characteristics of the refrigerating system. The temperature sensing chamber inside the housing is shielded against the ambient temperature and faithfully senses the temperature of the refrigerant within the low-pressure passage corresponding with the evaporator outlet-temperature. Both measures lead to an optimized performance of the refrigerating system within a relatively wide range of operating- and load conditions. The expansion valve becomes capable of supplying the evaporator for practically each load value (temperature) with a correct flow of refrigerant. As a consequence the capacity of the evaporator is used as efficient as possible. The cooling efficiency of the refrigerating becomes high. The pull-down-behaviour of the refrigerating system is excellent. The required cooling temperature is reached relatively rapidly and is significantly lower than in prior art refrigerating systems with the same design and capacity. Due to the adsorbing and releasing effect of the adsorbent material and the exclusion of ambient temperature influences on the chamber, the chamber furthermore responds to temperature changes slowly. Hunting thus is prevented. The individual adaptability of the pressure/temperature curve of the chamber, the faithfull sensing of the refrigerant temperature and the thus enhanced efficiency of the refrigerating system allow the advantageous use of a modern load-controlled compressor, the output of which can be controlled almost to zero despite the fact that the compressor runs at normal speed.

BRIEF DESCRIPTION OF THE DRAWINGS

The present invention may be more fully understood from the description of a preferred embodiment of the invention set forth below, together with the accompanying drawings, in which.

DESCRIPTION OF THE EMBODIMENT

Figure 1:
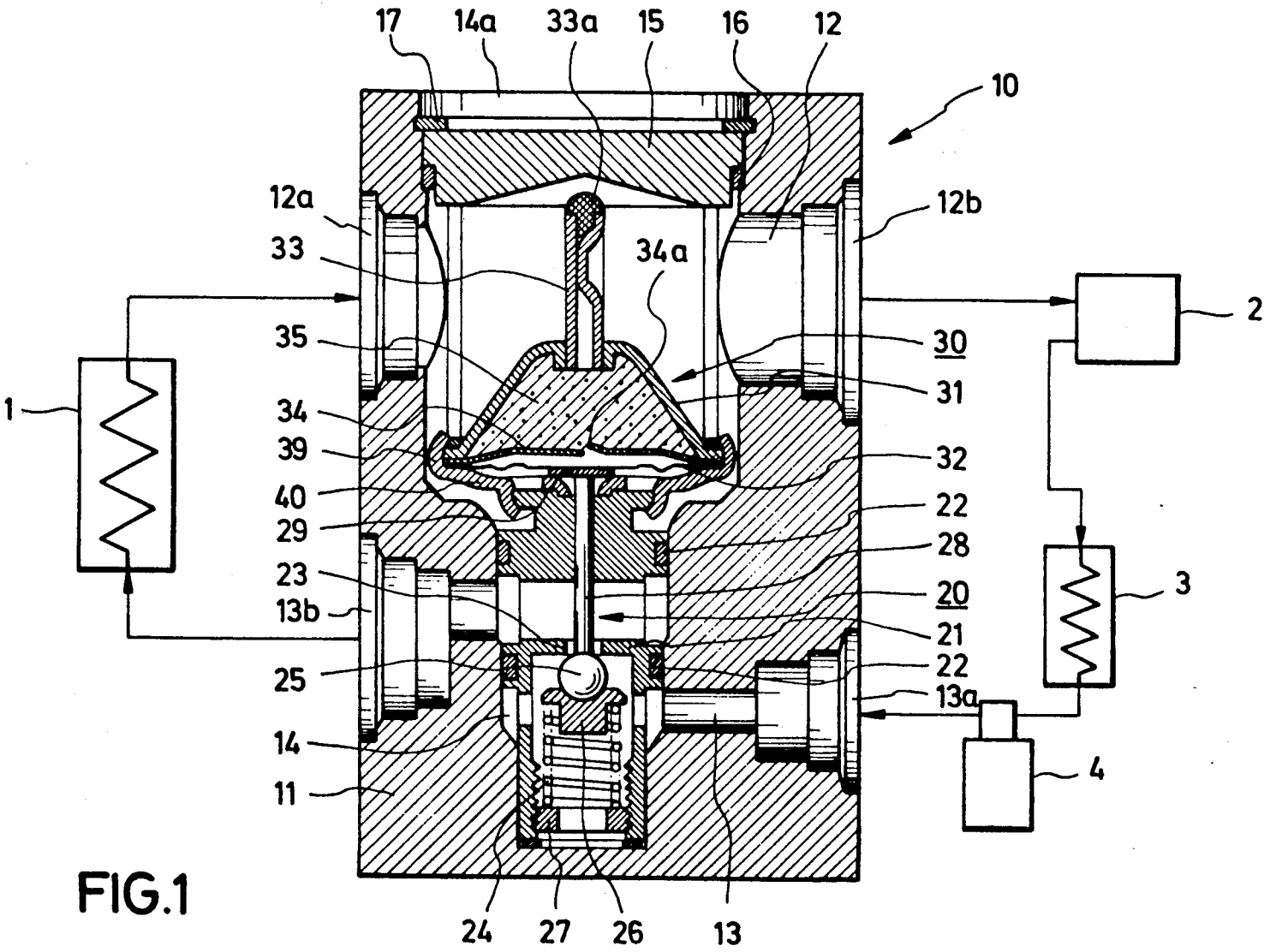
FIG. 1 is a sectional front elevational view of one embodiment of the present invention.

Referring to FIG. 1, which shows a refrigerating system according to one embodiment of the present invention, the reference numeral 1 denotes an evaporator, 2 a compressor, 3 a condenser, and 4 a reservoir which is connected to the outlet side of the condenser 3 to accommodate high-pressure liquid refrigerant. The reference numeral 10 denotes an expansion valve.

The expansion valve 10 includes a block 11 which is formed with a low-pressure passage 12 for passing low-temperature and low-pressure refrigerant and a passage 13 for adiabatically expanding high-temperature and high-pressure refrigerant.

The low-pressure passage 12 has one end (inlet side) **12*a* thereof connected to the outlet of the evaporator 1 and the other end (outlet side) 12*b* thereof connected to the inlet of the compressor 2. The passage 13 for adiabatic expansion which is formed in a crank shape has one end (inlet side) 13*a* thereof connected to the outlet of the reservoir 4 and the other end (outlet side) 13*b* thereof connected to the inlet of the evaporator 1**.

The low-pressure passage 12 and the passage 13 for adiabatic expansion are formed so as to be parallel to each other. A through-hole 14 is bored in the block 11 from the side thereof which is closer to the low-pressure passage 12, the through-hole 14 vertically extending through the two passages 12 and 13. The diameter of the through-hole 14 decreases toward the inner side (the lower side as viewed in the figure). The through-hole 14 does not extend through the block 11 but the innermost portion of the through-hole 14 terminates within the block 11.

A relatively-large bore **14*a* is formed in the block 11 at the outer side (the upper side as viewed in the figure) of the low-pressure passage 12, the bore 14*a* opening to the outside of the expansion valve 10. The bore 14*a* is closed with a plug 15. The reference numeral 16 denotes an O-ring for sealing, and 17 a ring which prevents the plug 15** from coming off.

A valve mechanism 20 is provided inside the through-hole 14. The valve mechanism 20 includes a body 21 which is fitted in the through-hole 14. The fit portion of the body 21 is sealed with two O-rings 22. A valve seat 23 is formed in the center of the valve mechanism body 21. The arrangement is such that, when the valve seat 23 is closed with a ball valve 25 which is biased toward the valve seat 23 from below by means of a coil spring 24, the passage 13 for adiabatic expansion is closed.

The reference numeral 26 denotes a ball valve retainer for supporting the ball valve 25, and 27 an adjusting nut which is in thread engagement with the valve mechanism body 21 for adjusting the level of biasing force from the coil spring 24.

A rod 28 is provided in the valve mechanism body 21 in such a manner that it is slidable in the axial direction. The upper end of the rod 28 projects from the valve mechanism body 21, while the lower end of the rod 28 abuts on the upper end of the ball valve 25. Accordingly, if the ball valve 25 is pushed through the rod 28 so as to move downward against the biasing force from the coil spring 24, the passage 13 for adiabatic expansion is opened, and the passage area of the passage 13 changes in accordance with the amount of movement of the rod 28, thus causing a change in the flow rate of the refrigerant supplied to the evaporator 1.

A temperature-sensing chamber 30 is provided inside the low-pressure passage 12 between the valve mechanism 20 and the plug 15, the chamber 30 being arranged to change in pressure in response to a change in temperature of the low-pressure refrigerant in the low-pressure passage 12 to thereby drive the rod 28. Since the temperature-sensing chamber 30 is provided inside the low-pressure passage 12, the operation thereof is not affected by the ambient temperature.

The temperature-sensing chamber 30 is surrounded by a housing 31, and the lower side thereof is constituted by a diaphragm 32 which is formed from a thin flexible film. A gas which is the same as the refrigerant circulated through the passages 12 and 13 or which is similar in properties to the refrigerant is sealed in the temperature-sensing chamber 30. An injection tube 33 for sealing the gas is crushed at the intermediate portion thereof and an injection port **33*a* thereof is closed with a silver-alloy brazing material or the like after the gas has been injected into the chamber 30. Accordingly, the temperature-sensing chamber 30 is hermetically sealed completely with the housing 31, the diaphragm 32 and the injection tube 33**.

A partition plate 34 is secured inside the temperature-sensing chamber 30 with a slight gap provided between the same and the diaphragm 32. The space that is surrounded by the partition plate 34 and the housing 31 is filled with an adsorbent 35. The adsorbent 35 adsorbs the gas in the temperature-sensing chamber 30 when the temperature is relatively low and it releases the adsorbed gas when the temperature is relatively high. For example, activated carbon may be employed as the adsorbent 35. However, any adsorbent may be employed besides activated carbon.

The partition plate 34 is provided for the purpose of isolating the diaphragm 32 from the adsorbent 35 to ensure the movement of the diaphragm 32. The partition plate 34 also serves as a stopper which prevents the diaphragm 32 from being excessively deformed toward the inside of the temperature-sensing chamber 30 and thereby damaged or broken. The partition plate 34 is provided with a slit **34*a* which prevents passage of the adsorbent 35 but allows the gas to pass freely, thereby enabling the levels of pressures at the upper and lower sides of the partition plate 34** to be equal to each other at all times.

The temperature-sensing chamber 30 is secured at the lower part thereof to the upper end portion of the valve mechanism body 21. Any means may be employed to secure the temperature-sensing chamber 30. In this embodiment, the chamber 30 is secured by means of caulking using a caulking member 39. It should be noted that the caulking member 39 may be formed as being an integral part of the valve mechanism body 21. The reference numeral 40 denotes a communicating bore for constantly equalizing the pressure at the lower side of the diaphragm 32 with the refrigerant pressure inside the low-pressure passage 12.

Thus, the temperature-sensing chamber 30 and the valve mechanism 20 are formed together in one unit through the caulking member 39. The temperature-sensing chamber 30 has a larger diameter than the valve mechanism body 20, 21, as shown in FIG. 1. The greatest diameter (the greatest outer diameter of the caulking member 39 in this embodiment) is made slightly smaller than the diameter of the plug 15. Therefore, with the plug 15 removed from the block 11 of the expansion valve 10, the temperature-sensing chamber 30 and the valve mechanism 20 can be set inside the block 11 and also removed therefrom in one unit.

Accordingly, assembly and maintenance, for example, replacement, of the temperature-sensing chamber 30 and the valve mechanism 20 are facilitated. Even when a trouble which cannot be fixed occurs, it is only necessary to replace the unit comprising the temperature-sensing chamber 30 and the valve mechanism 20 and it is unnecessary to discard the whole expansion valve unit.

The top of the rod 28 abuts against the central portion of the lower side of the diaphragm 32 through a backing plate 29. Accordingly, when the pressure inside the temperature-sensing chamber 30 rises relative to the refrigerant pressure inside the low-pressure passage 12, the diaphragm 32 is pushed downward. The force from the downward displacement of the diaphragm 32 and the force from the pressure of the expanded refrigerant from the inlet **13*b* of the evaporator 1 act together in an opening direction on the ball valve 25, as evident from FIG. 1. As a result, the ball valve 35 is pushed downward through the rod 28 to open the passage 13 for adiabatic expansion, thus increasing the flow rate of the refrigerant supplied to the evaporator 1**.

Conversely, when the pressure inside the temperature-sensing chamber 30 lowers, the diaphragm 32 is pulled up and the ball valve 25 that is constantly biased by the coil spring 24 approaches the valve seat 23 correspondingly, thus reducing the flow rate of the refrigerant supplied to the evaporator 1. The force of the spring 24 and the force of the high pressure refrigerant from the outlet **13*a* of the reservoir 4 act together in a closing direction on the ball valve 25, as evident from FIG. 1**.

The above-described operation is attained on the basis of the fact that the gas inside the temperature-sensing chamber 30 rises and lowers in pressure in accordance with a temperature change and the fact that the adsorbent 35 inside the temperature-sensing chamber 30 adsorbs and releases the gas sealed in the temperature-sensing chamber 30 in accordance with a temperature change.

Figure 2:
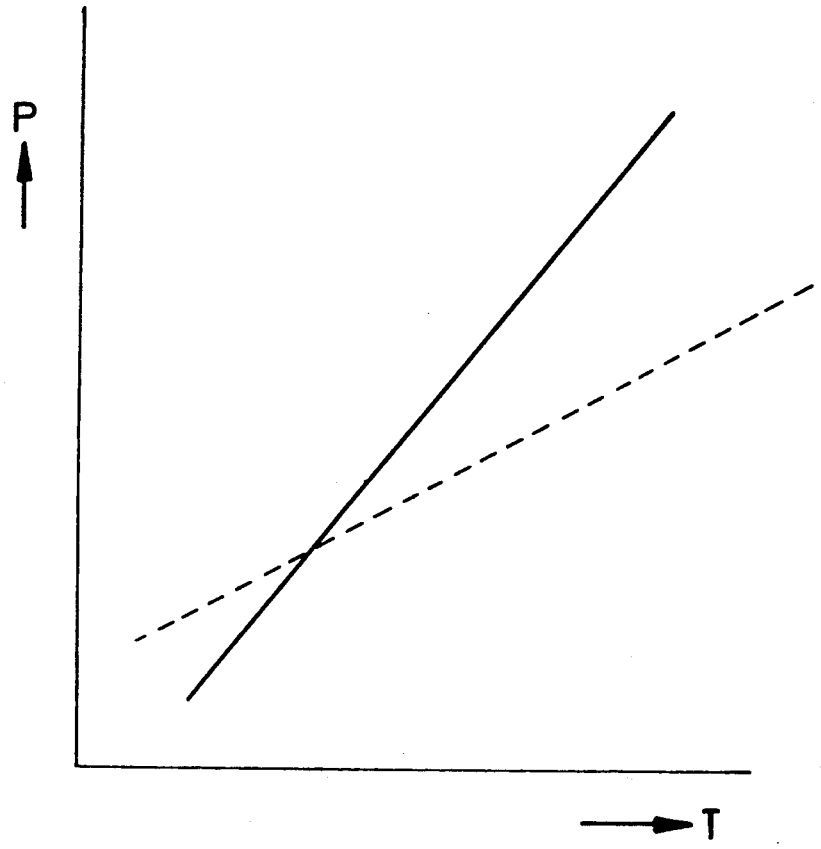
FIG. 2 is a graph showing temperature-pressure characteristics which is employed to explain the action of an adsorbent employed in the present invention.

Referring to FIG. 2, which is a graph exemplarily showing the action of the adsorbent 35, when the gas alone is sealed in the temperature-sensing chamber 30, the temperature (T) - pressure (P) characteristic curve is such as that shown by the chain line in FIG. 2, whereas, when the adsorbent 35 is employed, it is possible to obtain temperature-pressure characteristics exemplarily shown by the solid line in FIG. 2.

Accordingly, it is possible to control the flow rate of the refrigerant supplied to the evaporator 1 to a level close to an ideal with optimal temperature-pressure characteristics obtained by properly selecting the kind and amount of the adsorbent 35 and the kind and amount of the gas.

While the invention has been described by reference to a specific embodiment chosen for purposes of illustration, it should be apparent that numerous modifications could be made thereto by those skilled in the art without departing from the basic concept and scope of the invention.

What is claimed is:

1. An expansion valve (10) for controlling the flow rate of refrigerant supplied to an evaporator (1) of a refrigerating system, comprising:

a housing (11) provided with a low-pressure passage (12) and a passage (13), said low-pressure passage (12) being connected to the outlet of said evaporator (1) and to the inlet of a compressor (2) to pass low-temperature and low-pressure refrigerant;

said passage (13) being connected to the outlet of a reservoir (4) accommodating high-pressure liquid refrigerant and to the inlet of said evaporator (1) to adiabatically expand high-temperature and high-pressure refrigerant;

a temperature-sensing chamber (30) at least affected by the temperature of the refrigerant in said low-pressure passage (12), said chamber (30) containing at least a sealed charge of a gaseous medium and an adsorbent material both for converting a temperature change into a pressure change and having a wall responding by displacement to pressure changes of said gaseous medium in response to a change in the temperature of the refrigerant in said low-pressure-passage (12);

a valve mechanism (20) with a ball valve and valve seat (23, 25) in said passage (13), said valve mechanism (20) being actuated by displacement of said wall in response to a rise and lowering in pressure of said temperature-sensing chamber to open and close said passage (13) for adiabatic expansion of said refrigerant;

a spring (24) biasing said ball valve (25) against said valve seat (23) with the force of the spring (24) and force from the high pressure refrigerant from the reservoir (4) acting together in a closing direction on said ball valve (25); and a slidable rod (28) between said wall (32) and said ball valve (25) with the force from displacement of said wall (32) in response to a rise in pressure in said temperature-sensing chamber (30) and the force from pressure of the expanded refrigerant from the inlet **(13*b*) of the evaporator (1) acting together in an opening direction on said ball valve (25)**;

characterized in that said temperature-sensing chamber (30) is entirely provided inside said housing (11) and in said low-pressure-passage (12), and that said chamber (30) contains said sealed charge of gas and an adsorbent-material for adsorbing and releasing said gaseous medium in accordance with a temperature change so that said chamber (30) changes in pressure in response to a change in the temperature of the refrigerant in said low-pressure passage;

said housing (11) has an assembly bore (14) with a decreasing diameter extending from the side of the housing (11) lying closer to said low-pressure passage (12) through said passage (13); and said temperature-sensing chamber (30) and said valve mechanism (20) are formed as a replaceable unit mounted in said assembly bore (14), with said chamber (30) having a larger diameter than said valve mechanism (20).

2. Expansion valve according to claim 1, characterized in that the pressure/temperature-characteristics of said chamber (30) is preset to exactly correspond to not only one optimum superheat setting for one selected particular load value (temperature) of the refrigerating system, but is further preset to closely approximate to a required optimum operation characteristics of the refrigerating system in a series of different superheat settings corresponding with different load values (temperatures) of the refrigerating system beside the superheat setting belonging to said one particular load value.

3. Expansion valve according to claim 1, characterized in that the adsorbent material (35) adsorbs molecules of the gaseous medium at relatively low temperatures and releases said molecules at relatively high temperatures.

4. Expansion valve according to claim 1, characterized in that the adsorbent material (35) is activated carbon.

5. Expansion valve according to claim 1, characterized in that the pressure/temperature-characteristics of said chamber (30) is preset by the volumetrical ratio between the charge of gaseous medium and the adsorbent material (35) both contained in said chamber (30).

6. Expansion valve according to claim 1, characterized in that the pressure/temperature-characteristics of said chamber (30) is preset by the type, the particle-size and the amount of the adsorbent material and by the pressure of the gaseous medium sealed within said chamber (30).

7. Expansion valve according to claim 1, characterized by a selected combination of a gas type as the sealed gas charge and a selected type of adsorbing material in said chamber (30), using one adsorption performance of the adsorbent material, the adsorption performance of which is different from one type of gas to another of said different types of gases.

8. Expansion valve according to claim 1, characterized in that the gaseous medium sealed in said chamber (30) is the same as the refrigerant circulated in said passages (12, 13).

9. Expansion valve according to claim 1 characterized in that the gaseous medium sealed in said chamber (30) is similar in properties to the refrigerant circulated in said passages (12, 13).

10. Expansion valve according to claim 1, characterized in that said chamber (30) is protected against the ambient temperature outside said housing (11) by walls of said housing (11) and a plug (15) in an assembly bore (14a) of said housing (11) and is exclusively exposed to the temperature of the refrigerant within said low-pressure passage (12).

11. Expansion valve according to claim 1, characterized in that a flexible diaphragm (32) forms said displaceable wall of said chamber (30) and that the diaphragm (32) is displaced in response to a change in pressure of said temperature-sensing chamber (30) to drive said valve mechanism (20).

12. Expansion valve according to claim 11, characterized in that a partition wall (34) is provided within said chamber (30), said partition wall (34) separating said adsorbent material (35) from said diaphragm (32), and that said partition wall (34) is permeable for the gaseous medium but impermeable for the adsorbent material (35).

13. Expansion valve according to claim 12, characterized in that a slight gap is provided between the diaphragm (32) and the partition wall (34), and that said partition wall (34) forms a stopper for said diaphragm (32) preventing the diaphragm (32) from excessive deformations towards the interior of said chamber (30).

14. An expansion valve for controlling the flow rate of refrigerant supplied to an evaporator of a refrigerating system, comprising:

a housing provided with a low-pressure passage, said low-pressure passage being connected to the outlet of said evaporator and to the inlet of a compressor to pass low-temperature and low-pressure refrigerant;

a further passage being connected to the outlet of a reservoir accommodating high-pressure liquid refrigerant and to the inlet of said evaporator to adiabatically expand high-temperature and high-pressure refrigerant;

a temperature-sensing chamber at least affected by the temperature of the refrigerant in said low-pressure passage, said chamber containing at least a sealed charge of a gaseous medium and an adsorbent material both for converting a temperature change into a pressure change, said chamber having a wall responding to displacement of pressure changes in said chamber in response to a change in the temperature of the refrigerant in said low-pressure-passage;

a valve mechanism body with a valve in said further passage, said valve being actuated by displacement of said wall in response to a rising and lowering of the pressure in said chamber to open and close said further passage for adiabatic expansion of said refrigerant, said temperature sensing chamber and said valve mechanism body being secured together in one unit, said unit being mounted in an assembly bore of said housing with said temperature-sensing chamber being entirely provided inside said housing;

said assembly bore vertically extending through said passages; and said assembly bore having an open end in one side of said housing, a closed inner end within the housing and a plug closing said open end;

characterized in that said open end of said assembly bore being provided in a side of the housing lying closer to the low pressure passage than to the further passage, the diameter of said assembly bore decreasing from a relatively large bore at said open end towards an innermost portion terminating at said closed end with at least one diameter step between both said passages;

said valve mechanism body of said unit being fitted in said innermost portion of said assembly bore;

said temperature-sensing chamber being provided in said relatively large bore of said assembly bore between said valve mechanism body and said plug, wherein said temperature-sensing chamber has a larger diameter than said valve mechanism body; and said unit being removable through said open end of said assembly bore from said side of the housing closer to the low-pressure passage after removing said plug.

15. An expansion valve as in claim 14, wherein said chamber is protected against the ambient temperature outside said housing by walls of said housing in said relatively large bore and said plug closing said open end of said assembly bore.

16. An expansion valve as in claim 14, wherein said valve in said valve mechanism body is provided with a ball and a seat for said ball for opening and closing said further passage for adiabatic expansion, a spring biasing said ball against said seat in a direction in which said further passage is closed with the pressure at the outlet side of said reservoir acting in a closing direction on said ball and a rod extending between said ball and said displaceable wall of said temperature sensing chamber.

17. An expansion valve as in claim 14, wherein the pressure/temperature-characteristics of said temperature-sensing chamber is pre-set to exactly correspond to not only the one optimum superheat setting for one selected particular load value (temperature) of the refrigerating system, but is further pre-set to closely approximate a required optimum operation characteristic of the refrigerating system in a series of different superheat settings corresponding to different load values of the refrigerating system beside the superheat setting belonging to said one particular load value.

18. An expansion valve as in claim 14, wherein the pressure/temperature-characteristics of said temperature sensing chamber is pre-set by the volumetric ratio between the charge of gaseous medium and the adsorbent material in said chamber.

19. An expansion valve as in claim 14, wherein the pressure/temperature-characteristics of said temperature sensing chamber is pre-set by the type, the particle size and the amount of the adsorbent material, and by the pressure of the gaseous medium sealed within said chamber.

20. An expansion valve as in claim 19, wherein a selected combination of a gaseous medium type as the sealed gaseous charge and a selected type of adsorbent material in said chamber, said combination using one adsorption performance of the adsorbent material, the adsorption performance of which is different from one type of gaseous medium to another of said different types of gaseous mediums.

21. An expansion valve as in claim 19, wherein the adsorbent material is activated carbon.

* * * * *